US011170674B1

(12) United States Patent
Wu

(10) Patent No.: US 11,170,674 B1
(45) Date of Patent: Nov. 9, 2021

(54) DISPLAY ARRANGEMENT HAVING MAGNET THAT INTERACTS WITH A COIL TO INDUCE MOVEMENT OF THE DISPLAY ARRANGEMENT

(71) Applicant: Fourstar Group Inc., Taipei (TW)

(72) Inventor: Yu-Chi Wu, Taipei (TW)

(73) Assignee: Fourstar Group Inc., Taipei (TW)

( * ) Notice: Subject to any disclaimer, the term of this patent is extended or adjusted under 35 U.S.C. 154(b) by 0 days.

(21) Appl. No.: 17/146,594

(22) Filed: Jan. 12, 2021

(51) Int. Cl.

| | |
|---|---|
| ***G09F 19/08*** | (2006.01) |
| ***G09F 13/04*** | (2006.01) |
| ***G09F 13/34*** | (2006.01) |
| *G09F 25/00* | (2006.01) |

(52) U.S. Cl.
CPC ..... *G09F 19/08* (2013.01); *G09F 13/0404* (2013.01); *G09F 13/34* (2013.01); *G09F 13/0431* (2021.05); *G09F 25/00* (2013.01); *G09F 2019/088* (2013.01)

(58) Field of Classification Search
CPC . G09F 19/08; G09F 13/0404; G09F 2019/088
See application file for complete search history.

(56) References Cited

U.S. PATENT DOCUMENTS 2,051,992 A * 8/1936 John ..... G09F 11/34 40/485
3,835,561 A * 9/1974 Camerino ..... G09F 19/08 40/416
5,798,704 A 8/1998 Sabuncu
5,984,757 A * 11/1999 Tsai ..... A63H 13/12 335/219
6,198,247 B1 * 3/2001 Barr ..... G09F 19/08 318/568.1
7,218,214 B2 5/2007 Werner et al.
7,653,959 B1 2/2010 Catanzaro
D718,183 S 11/2014 Wu et al.
D718,656 S 12/2014 Wu et al.
D719,058 S 12/2014 Wu et al.
D719,059 S 12/2014 Wu et al.
9,661,944 B2 5/2017 Wu et al.
10,172,485 B2 1/2019 Wu et al.
2003/0128553 A1 * 7/2003 Chin-Cheng ..... G09F 15/0025 362/257
2007/0099536 A1 * 5/2007 Mo ..... G09F 19/08 446/276

(Continued)

*Primary Examiner* — Gary C Hoge
(74) *Attorney, Agent, or Firm* — Salter & Michaelson

(57) ABSTRACT

A display arrangement includes a base, a decorative shell having a front cover and a back cover, an elongated central post that is rotatably coupled to the decorative shell and fixedly coupled to the base, a light source disposed on the elongated central post and within the shell, such that the light is visible though at least one opening in the shell, a stem coupled to the shell and coupled to the elongated central post, the stem having a magnet on one end, and a coil configured to receive energy from a power source to cause an arcing motion of the magnet, the stem, and thereby the decorative shell. The display arrangement can include a second shell disposed horizontally above the decorative shell and coupled to the decorative shell, and can also include a third shell disposed horizontally below the decorative shell, and that is coupled to the decorative shell.

20 Claims, 12 Drawing Sheets

(56) References Cited

U.S. PATENT DOCUMENTS

| | | | | |
|---|---|---|---|---|
| 2008/0301985 | A1* | 12/2008 | Tsao | G09F 19/08 40/423 |
| 2009/0183402 | A1* | 7/2009 | Tsao | G09F 19/08 40/423 |
| 2015/0182868 | A1* | 7/2015 | Wu | A47G 7/08 446/484 |

* cited by examiner

DISPLAY ARRANGEMENT HAVING MAGNET THAT INTERACTS WITH A COIL TO INDUCE MOVEMENT OF THE DISPLAY ARRANGEMENT

FIELD OF THE INVENTION

The present invention relates in general to a display arrangement having a stem or lever with a magnet that interacts with a coil to induce movement of the display arrangement. The present invention relates more particularly to a display arrangement having a light source such as a light emitting diode (LED) that is connected to the stem or lever.

SUMMARY OF THE INVENTION

The present invention is directed to a display arrangement including a base, a decorative shell having a front cover and a back cover, an elongated central post that is rotatably coupled to the decorative shell and fixedly coupled to the base, a light source disposed on the elongated central post and within the shell, such that the light is visible though at least one opening in the shell, a stem coupled to the shell and coupled to the elongated central post, the stem having a magnet on one end, and a coil configured to receive energy from a power source to cause an arcing motion of the magnet, the stem, and thereby the decorative shell.

In the display arrangement, the power source can be a battery or a solar power source. The display arrangement of claim 1, further comprising a second shell disposed horizontally above the decorative shell, that is coupled to the decorative shell by a second post that is also coupled to the elongated central post. The display arrangement can further include a third shell disposed horizontally below the decorative shell, that is coupled to the decorative shell by a loop on the third shell that engages with a peg on the decorative shell. In the display arrangement, the elongated central post includes a second light source visible through the second shell, and the elongated central post includes a third light source visible through the third shell. In the display arrangement, wherein the light source is a light emitting diode (LED).

A display arrangement including a base, a lower shell portion having a lower back cover and a lower front cover, a middle shell portion having a middle back cover and a middle front cover, the middle shell portion rotatably coupled to the lower shell portion, a top shell portion having a top back cover and a top front cover, the top shell portion rotatably coupled to the middle shell portion, an elongated central post having a first light source visible through an opening in the lower front cover, a second light source visible through an opening in the middle front cover, and a third light source visible through an opening in the top front cover, a stem coupled to the elongated central post and coupled to at least the middle shell portion, the stem having a magnet on one end, and a coil configured to receive energy from a power source to cause an arcing motion of the magnet and the stem, to thereby cause the middle shell portion, the lower shell portion, and the top shell portion to rotate with respect to one another.

The display arrangement can further include an upper post having a first peg and an opposed second peg, the first peg configured to engage with the top back cover and the second peg configured to engage with the top front cover. The display arrangement can include a bottom end of the upper post has opposed third and fourth pegs that pivotally connected to the middle shell. The display arrangement can further include a post rotationally connected to the middle shell portion and rotationally connected to the stem, such that movement of the stem causes movement of the middle shell portion. The display arrangement can further include a peg on the stem configured to pivotally connect to the back bottom cover. The display arrangement can further include a third shell disposed horizontally below the decorative shell, wherein the lower shell portion is coupled to the middle shell portion by a loop on the third shell that engages with a peg on the decorative shell. The display arrangement can include a lower post that extends upwardly from the base and that is coupled to the middle shell portion by a loop that engages with a peg.

A display arrangement including a base, a lower shell portion having a lower back cover and a lower front cover, a middle shell portion having a middle back cover and a middle front cover, the middle shell portion rotatably coupled to the lower shell portion, a top shell portion having a top back cover and a top front cover, the top shell portion rotatably coupled to the middle shell portion, a stem coupled to at least the middle shell portion, the stem having a magnet on one end, and a coil configured to receive energy from a power source to cause an arcing motion of the magnet and the stem, to thereby cause the middle shell portion, the lower shell portion, and the top shell portion to rotate.

The device can include an elongated post having a first light source visible through an opening in the lower front cover. The display arrangement can include a second light source on the central elongated post that is visible through an opening in the middle front cover, and a third light source visible through a second opening in the middle front cover. The display arrangement of claim 15, further comprising a fourth light source on the central elongated post that is visible through an opening on the top front cover and a fifth light source visible through a second opening in the top front cover. The display arrangement can further include a post pivotally connected to the middle shell portion and rotationally connected to the stem, such that movement of the stem causes movement of the middle shell portion. The display arrangement of claim 15, wherein the top shell portion defines a pumpkin shape having a hat, the middle shell portion defines a second pumpkin shape, and the lower shell portion defines a third pumpkin shape.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

In accordance with the present invention as illustrated in FIGS. 1-11, there is provided a display arrangement having a magnet that interacts with a coil to induce movement of the display arrangement. The display arrangement can include a single shell, or a configuration that includes a top shell portion, a middle shell portion, and a lower shell portion. The display arrangement can further include at least one light source disposed in the single shell or in one or more of the top, middle, and lower shell portions. The magnet can be disposed on a stem or lever that is coupled to at least one shell or shell portion, so that reciprocating or arcing movement of the magnet causes movement of the shell or shell portion.

Figure 1:
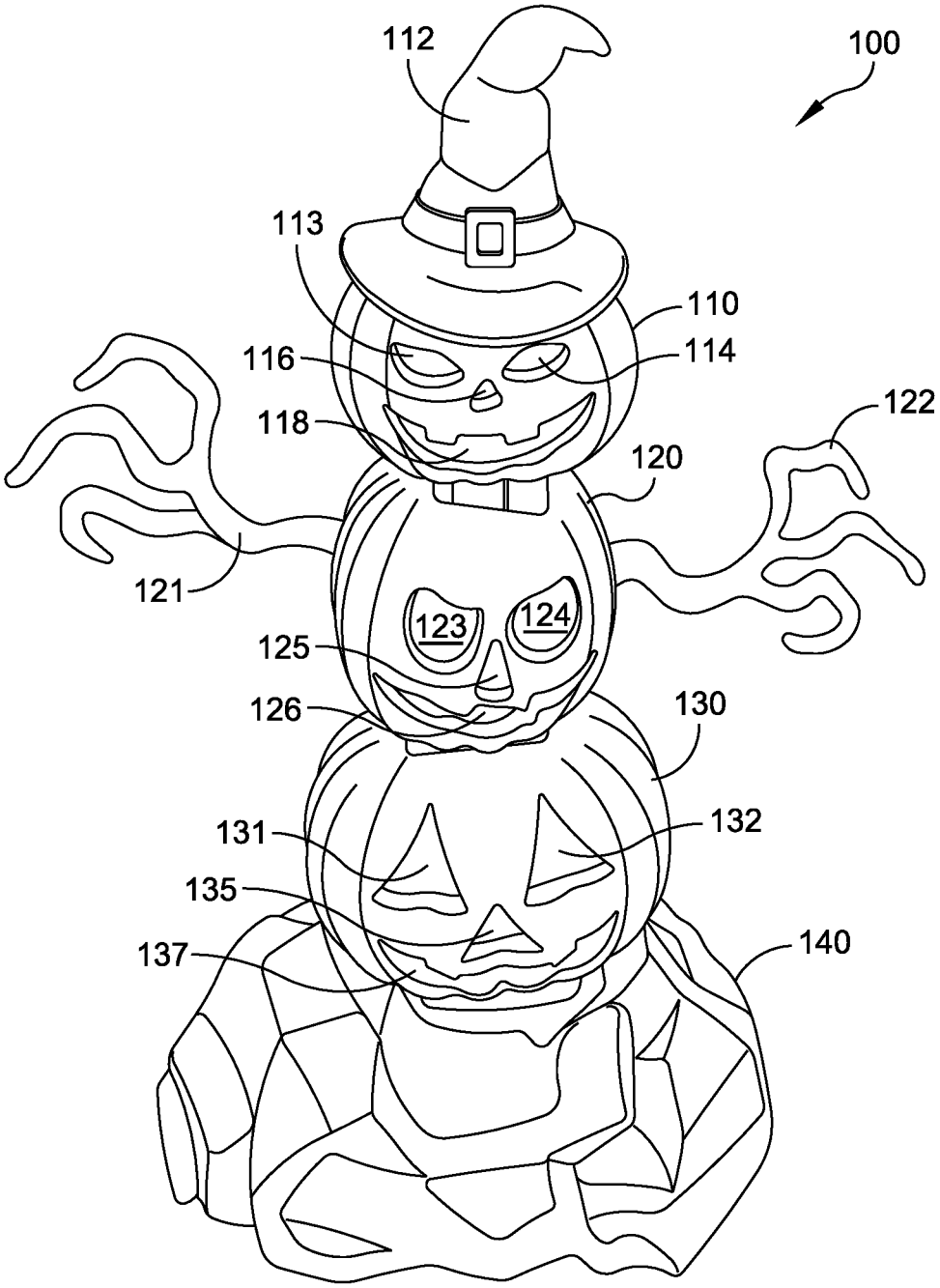
FIG. 1 is a perspective view showing a display arrangement having a magnet that interacts with a coil to induce movement of the display arrangement, where the display arrangement is in the configuration of a pumpkin figure, according to the present disclosure.

Reference is made to FIG. 1 is a perspective view showing a display arrangement 100 having a magnet that interacts with a coil to induce movement of the display arrangement 100, where the display arrangement is in the configuration of a pumpkin figure, according to the present disclosure. The display arrangement 100 includes a top shell portion 110, a middle or center shell portion 120, a bottom shell portion 130, and a base 140. The top shell portion 110 can include a decorative hat 112, openings 113, 114 in the form of eyes, opening 116 in the form of a nose, and opening 118 in the form of a mouth, that can together form a pumpkin configuration. The middle shell portion 120 can include a pair of arms 121, 122, openings 123, 124 in the form of eyes, opening 125 in the form of a nose, and an opening 126 in the form of a mouth, that together form a second pumpkin configuration. The bottom shell portion 130 can include openings 131, 132 in the form of eyes, opening 135 in the form of a nose, and opening 137 in the form of a mouth, that together form a third pumpkin configuration. As will be appreciated in light of the present disclosure, one or more light sources can be positioned within each of the top shell portion 110, the middle shell portion 120, and the bottom shell portion 130, such that light emanates through the openings on each of the portions.

Figure 2:
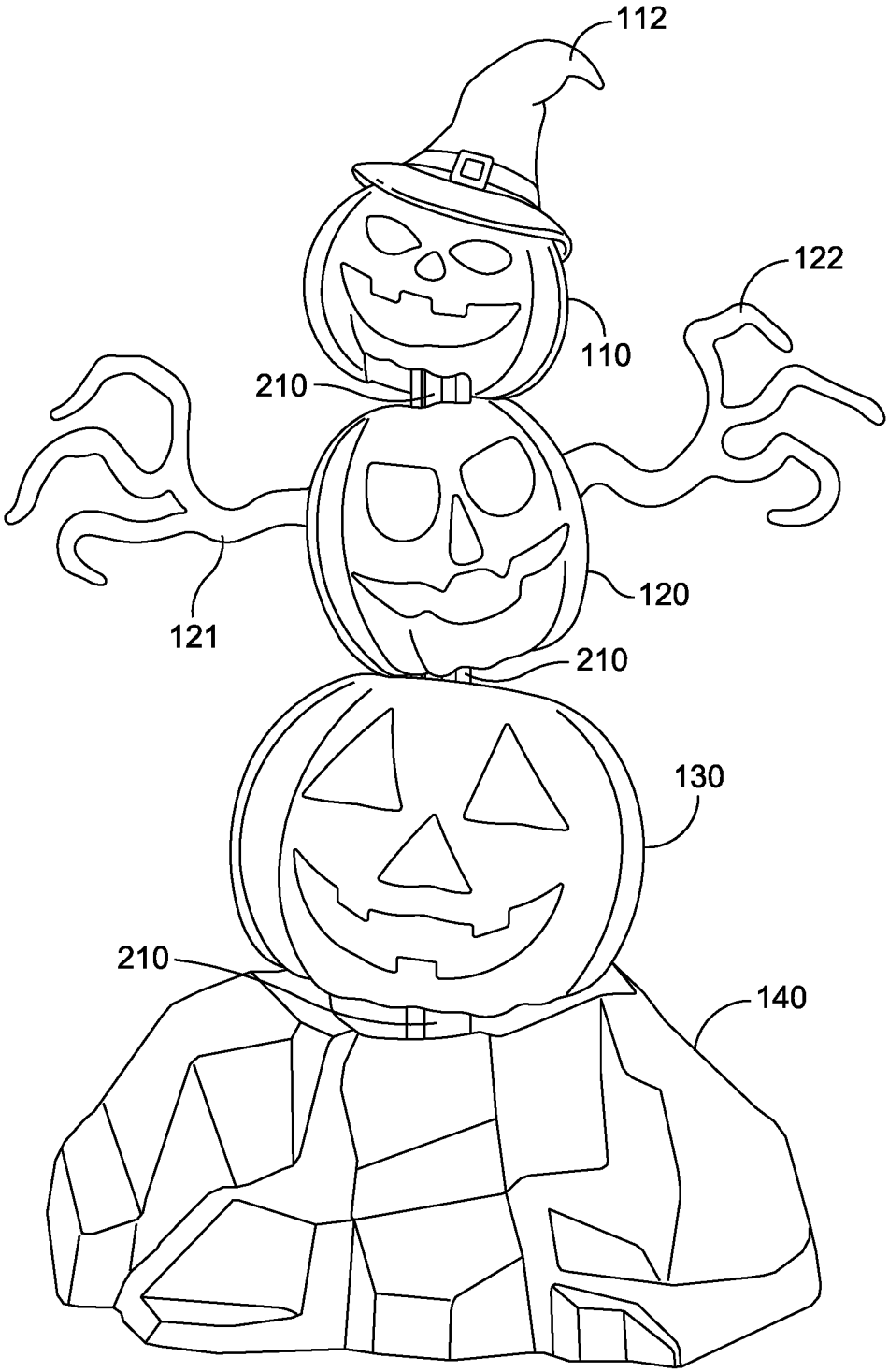
FIG. 2 is a front view of the display arrangement, according to the present disclosure.
Figure 3:
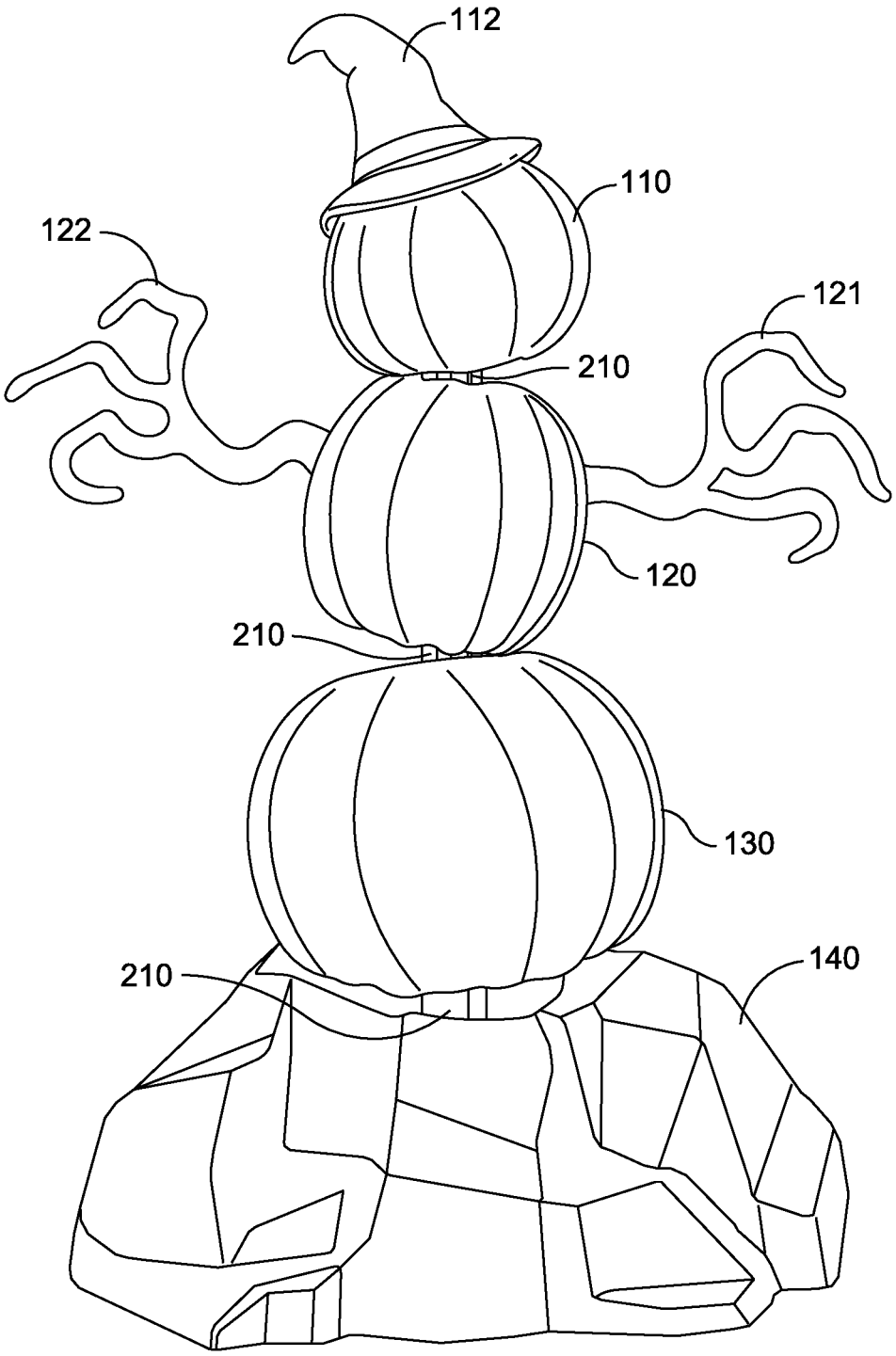
FIG. 3 is a back view of the display arrangement, according to the present disclosure.

FIG. 2 is a front view of the display arrangement, according to the present disclosure. The arrangement 100 includes an elongated central post 210 that is fixed to the base 140 and pivotally connected to each of the top shell portion 110, the middle shell portion 120, and the bottom shell portion 130. FIG. 3 shows the display arrangement from the back view.

Figure 4:
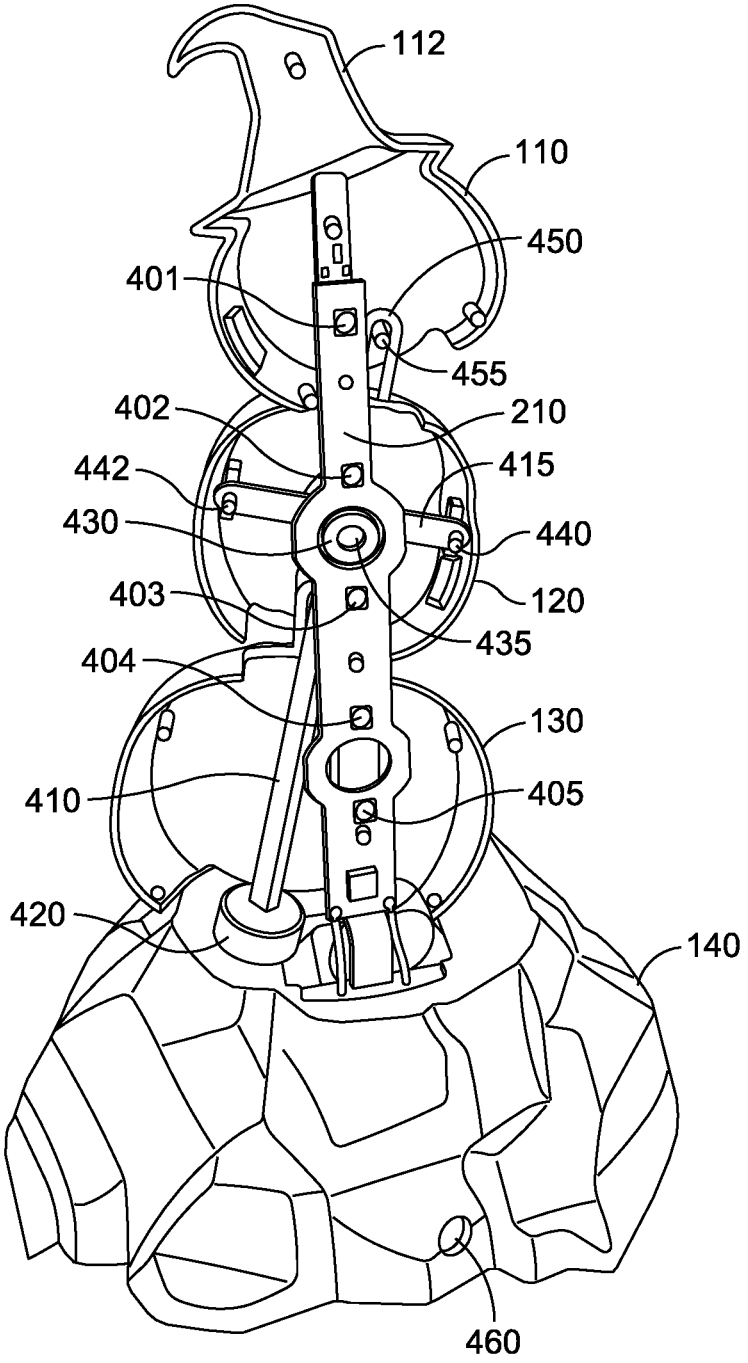
FIG. 4 is a front view of the display arrangement, according to the present disclosure, with the front cover removed for each of the top, middle, and bottom shell portions, to show the internal details of the movement arrangement, and with the stem and magnet in a leftmost position.

FIG. 4 is a front view of the display arrangement, according to the present disclosure, with the front cover removed for each of the top, middle, and bottom shell portions, to show the internal details of the movement arrangement, and with the stem and magnet in a leftmost position. The elongated central post 210 is more clearly visible in this view, with the front covers removed. The elongated central post 210 includes five light sources 401, 402, 403, 404, and 405 in this example, which may be light emitting diodes (LEDs). Although five LEDs are shown, any number of LEDs may be implemented. The light sources can be powered by several different means including a battery, a solar power source, or from an AC outlet, for example. The stem 410 is visible, which is pivotally connected to the middle shell portion on a top end and has a magnet 420 on its bottom end. The elongated central post 210 does not move. The stem 410 moves with respect to the elongated central post 210, and thus causes the top shell portion 110, the middle shell portion 120, and the bottom shell portion 130 to correspondingly move and pivot as the stem 410 reciprocates between a leftmost position and a rightmost position. The post 210 has a ring 430 that receives a peg 435 at the top end of the stem 410. The peg 435 functions as a pivot location for the stem 410. The pegs 440, 442 are for securing the front cover (not shown) to the back cover of the middle shell portion 130. The middle shell portion 120, which may be referred to herein as a "decorative shell" or "center shell" portion, includes a loop 450 that engages with a peg 455 on the back cover of the top shell portion 110. The peg 455 engaging the loop 450 in a sliding manner allows for restrained movement of the top shell portion with respect to the middle shell portion, in response to movement of the magnet 420 and associated stem 410.

The base 140 or post 210 can include a speaker (not shown in FIG. 4) that allows for sound to be played by the device 100. The sound can be a song stored in memory within the base 140. The speaker can be powered by the battery, solar power source, AC outlet, or other power source that provides power to the device 100. The base 140 can include a sensor 460 that turns the sound on when the sensor detects motion proximate the base 140. The sensor 460 can be motion-activated or an infrared sensor, or other appropriate sensor for activating the sound.

Figure 5:
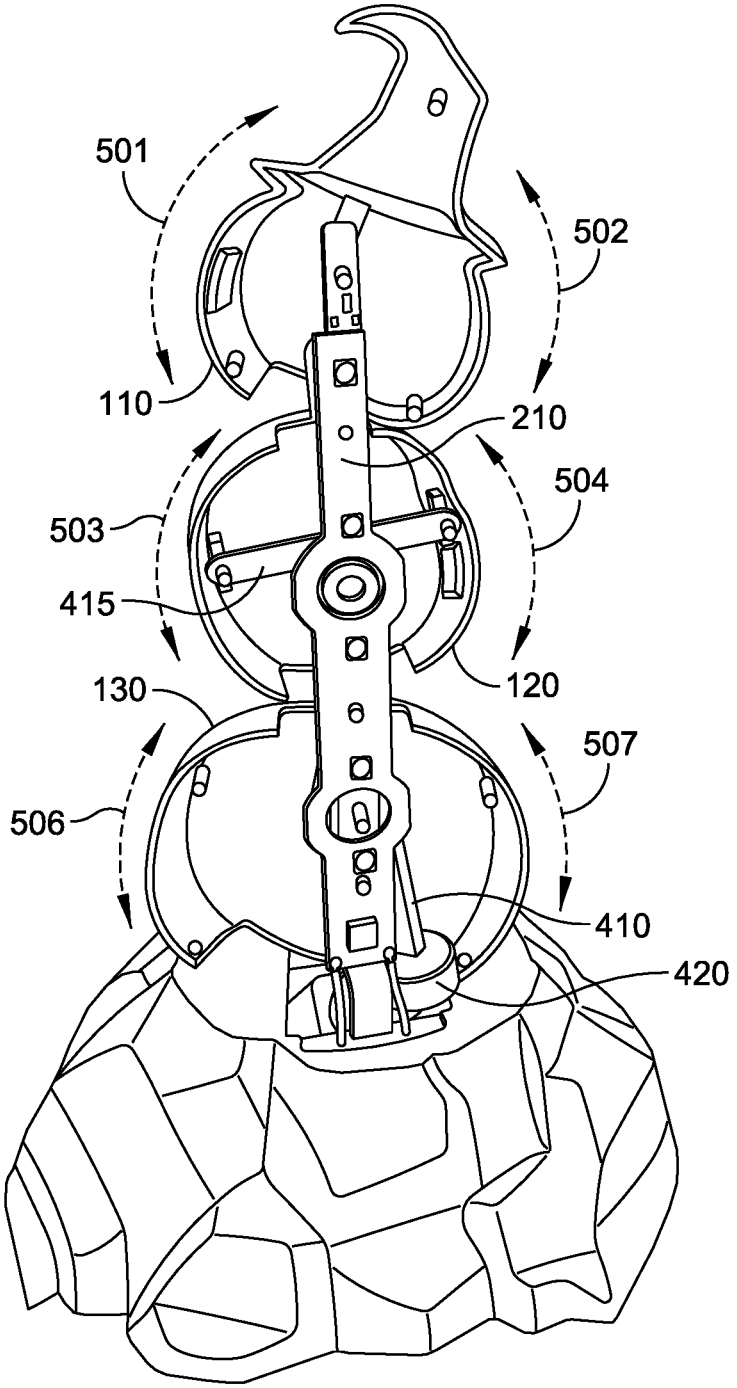
FIG. 5 is a front view of the display arrangement with the front covers moved, and with the stem and magnet in a rightmost position, according to the present disclosure.

FIG. 5 is a front view of the display arrangement with the front covers moved, and with the stem and magnet in a rightmost position, according to the present disclosure. Note that the position of the stem, and thus the shell portions, has changed to the alternate position as with respect to FIG. 4. The top shell portion 110 moves pivotally in the direction of arrows 501, 502. The middle shell portion 120 moves pivotally in the direction of arrows 503, 504. The bottom shell portion 130 moves pivotally in the direction of arrows 506, 507.

Figure 6:
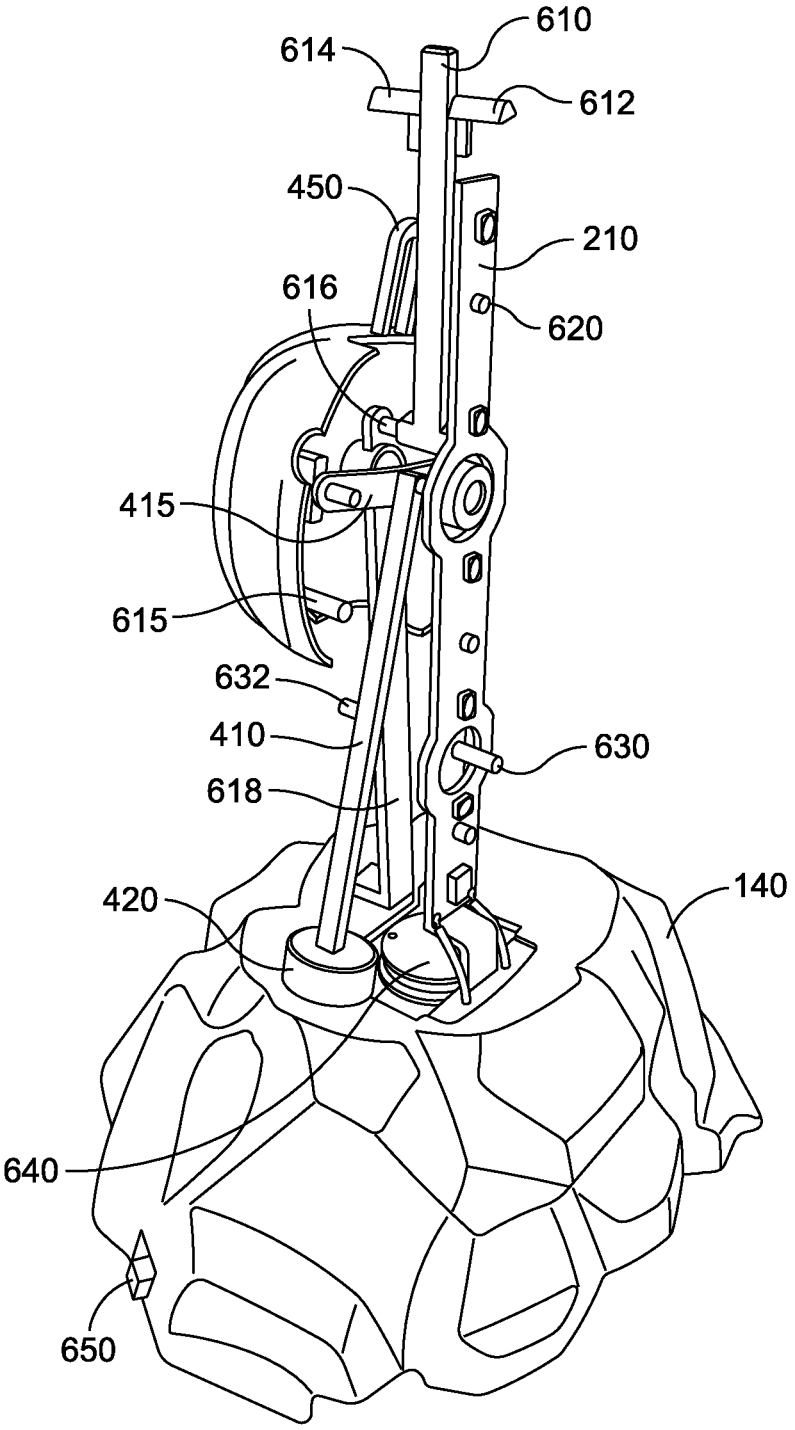
FIG. 6 is a perspective side view of the display arrangement, with the back cover also removed for the top shell portion and the bottom shell portion, to further show the internal components of the movement arrangement, with the stem and magnet shown in the leftmost position, according to the present disclosure.

FIG. 6 is a perspective side view of the display arrangement, with the back cover also removed for the top shell portion and the bottom shell portion, to further show the internal components of the movement arrangement, with the stem and magnet shown in the leftmost position, according to the present disclosure. The upper or top post 610 is clearly visible with the back cover of the top shell portion removed. The pegs 612 and 614 of the top post 610 engage with the front cover and back cover, respectively, of the top shell portion 110 (not shown in FIG. 6). The peg 615 engages with the loop (see loop 1051 shown in FIG. 10) of the bottom shell portion 130 (not shown in FIG. 6). The peg 616 is at the lower portion of the upper post 610 and engages with the first lower post 618, which is stationary and secured to the base 140. The pegs 630, 632 engage with the front and back cover, respectively, of the lower shell portion 130 (not shown in FIG. 6).

Figure 6A:
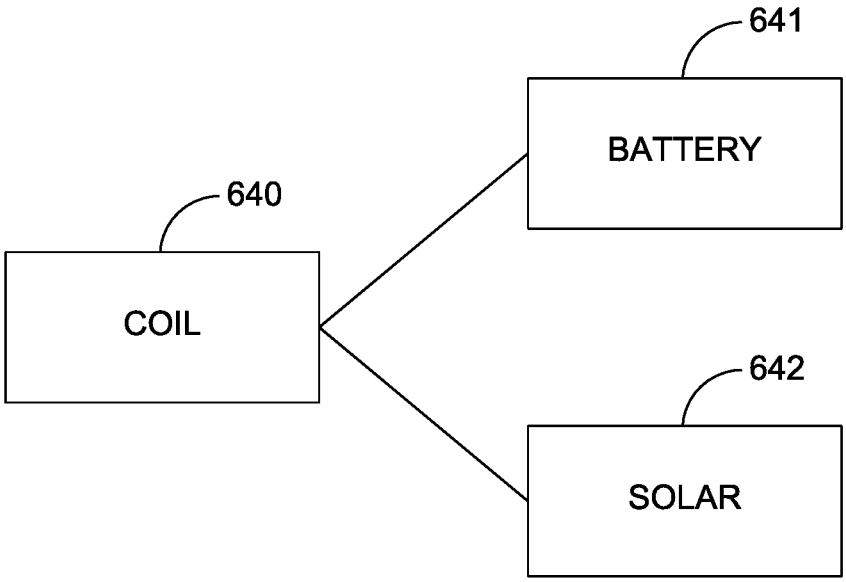
FIG. 6A is a simple block diagram illustrating the fact that the power for the activation coil can be derived either from a battery or a solar source.

The magnet 420 interacts with the coil 640, which operates in an arcing manner based on power from a power source, to thereby cause the magnet 420 to reciprocate back and forth. The arrangement can also include a switch 650 to turn the display arrangement on or off. As indicated previously, the power source can be a battery or a solar power source. In this connection, reference may be made to FIG. 6A which is a simple diagram showing the coil 640 being activated either from the battery 641 or the solar source 642.

Figure 7:
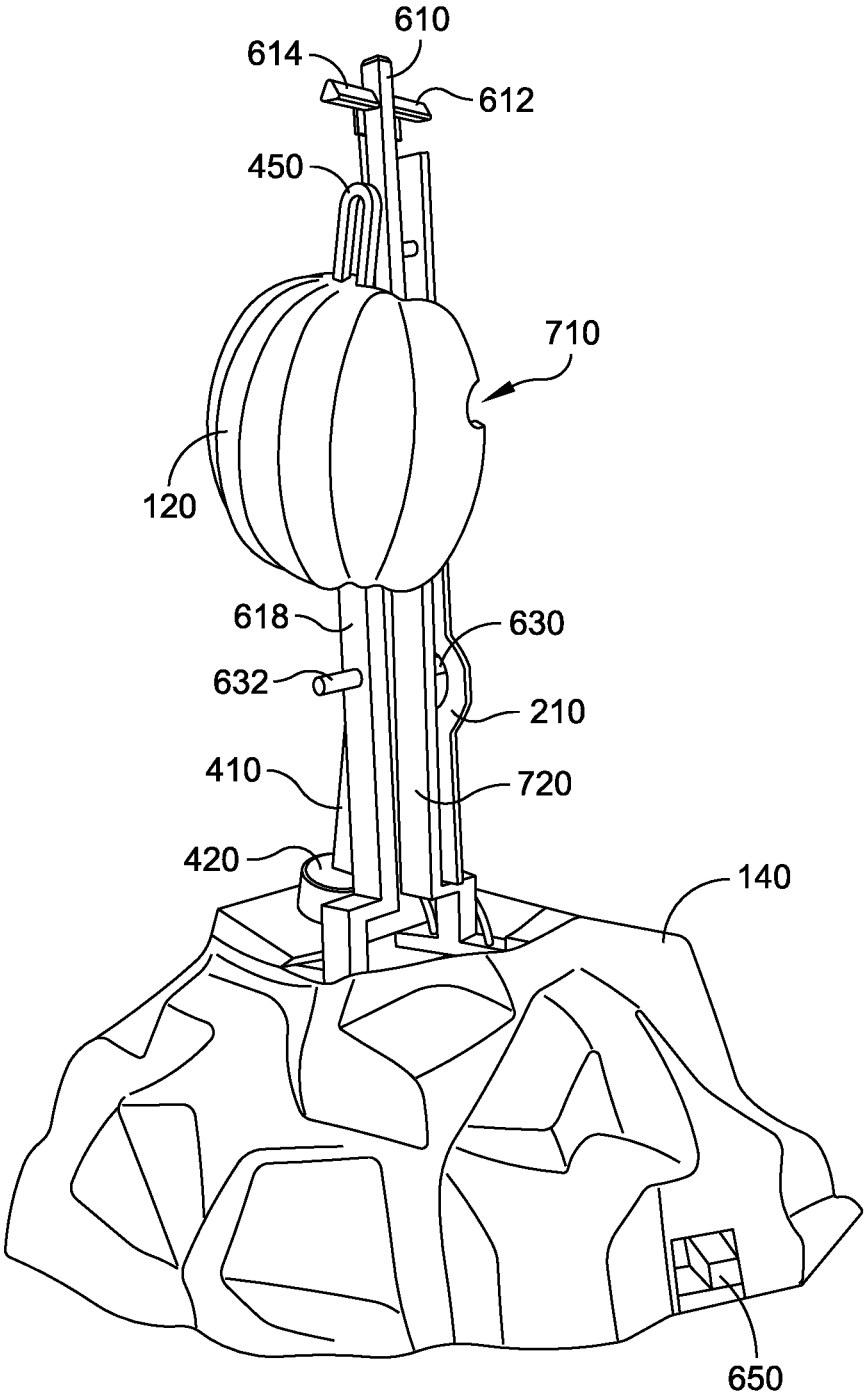
FIG. 7 is a perspective rear view of the display arrangement with the back cover removed for the top and bottom shell portions, with the stem and magnet shown in the rightmost position, according to the present disclosure.

FIG. 7 is a perspective rear view of the display arrangement with the back cover removed for the top and bottom shell portions, with the stem and magnet shown in the rightmost position, according to the present disclosure. Note that the back cover of the middle portion 120 can include a notch 710 for the arm 121. The second lower post 720 is visible in this view, and is fixedly secured to the base 140.

Figure 8:
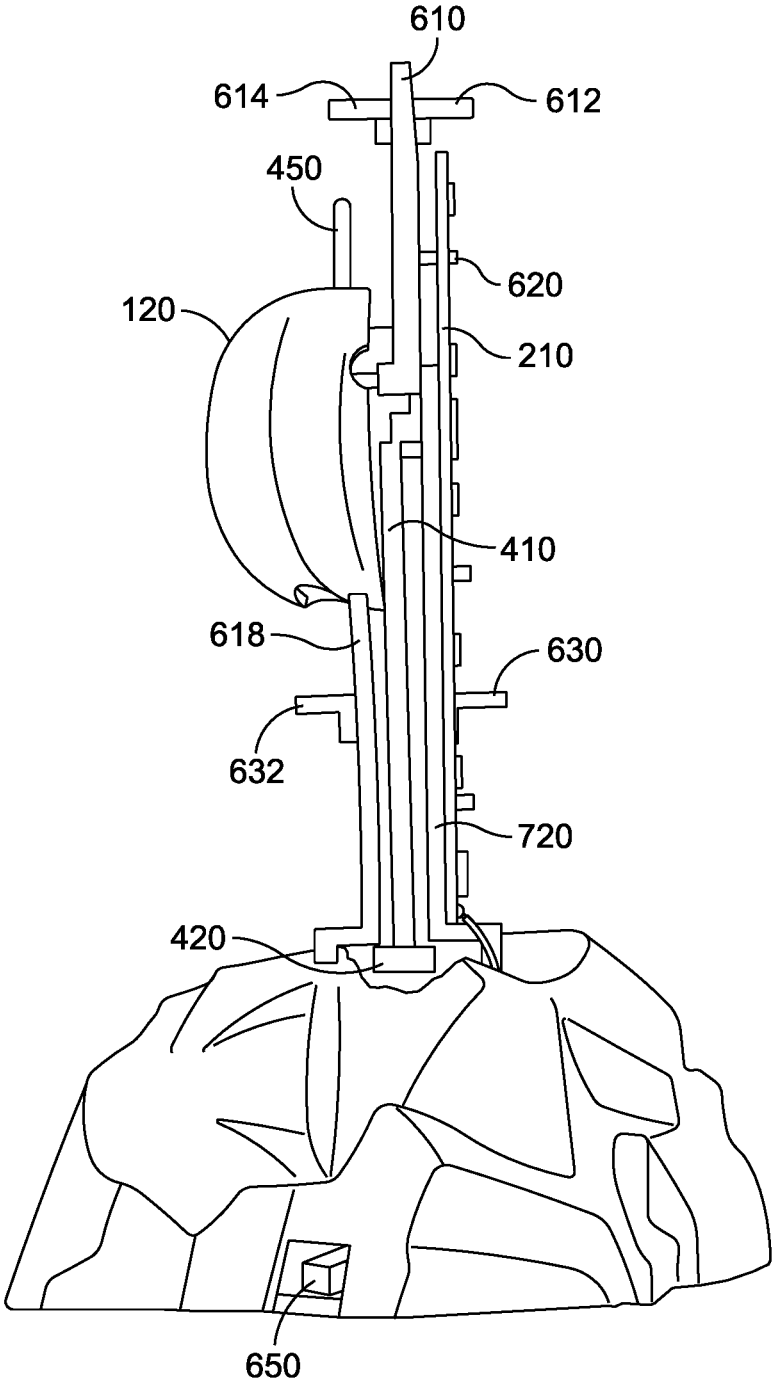
FIG. 8 is a side view of the display arrangement with the back cover removed for the top and bottom shell portions, according to the present disclosure.

FIG. 8 is a side view of the display arrangement with the back cover removed for the top and bottom shell portions, according to the present disclosure.

Figure 9:
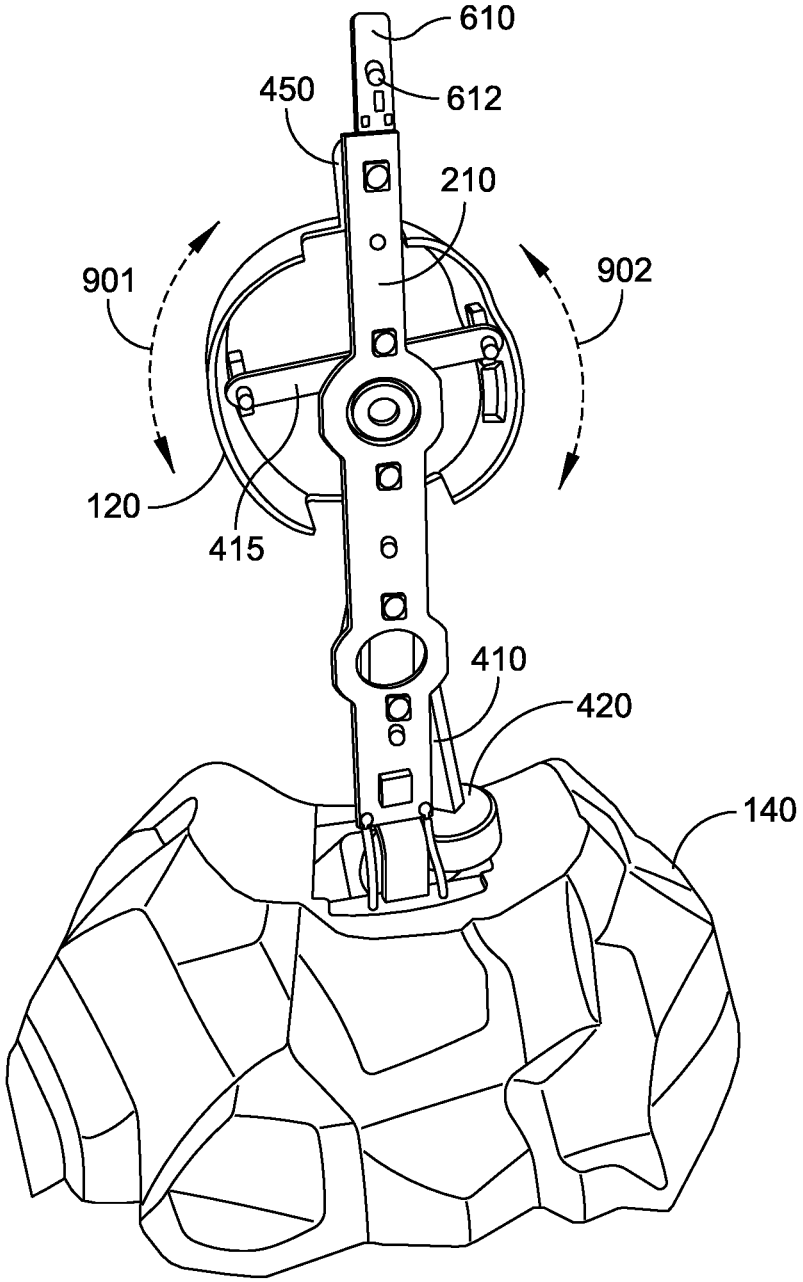
FIG. 9 is a front perspective view of the display arrangement with the back cover removed for the top and bottom shell portions, and illustrating the rotational movement of the middle shell portion, according to the present disclosure.

FIG. 9 is a front perspective view of the display arrangement with the back cover removed for the top and bottom shell portions and illustrating the rotational movement of the middle shell portion, according to the present disclosure. The arrows 901, 902 show the movement of the back cover of the middle shell portion 120. The post 415 is pivotally connected to the stem at the peg 435 such that movement of the stem from side-to-side causes corresponding pivoting movement of the post 415 and thus the middle shell portion 120.

Figure 10:
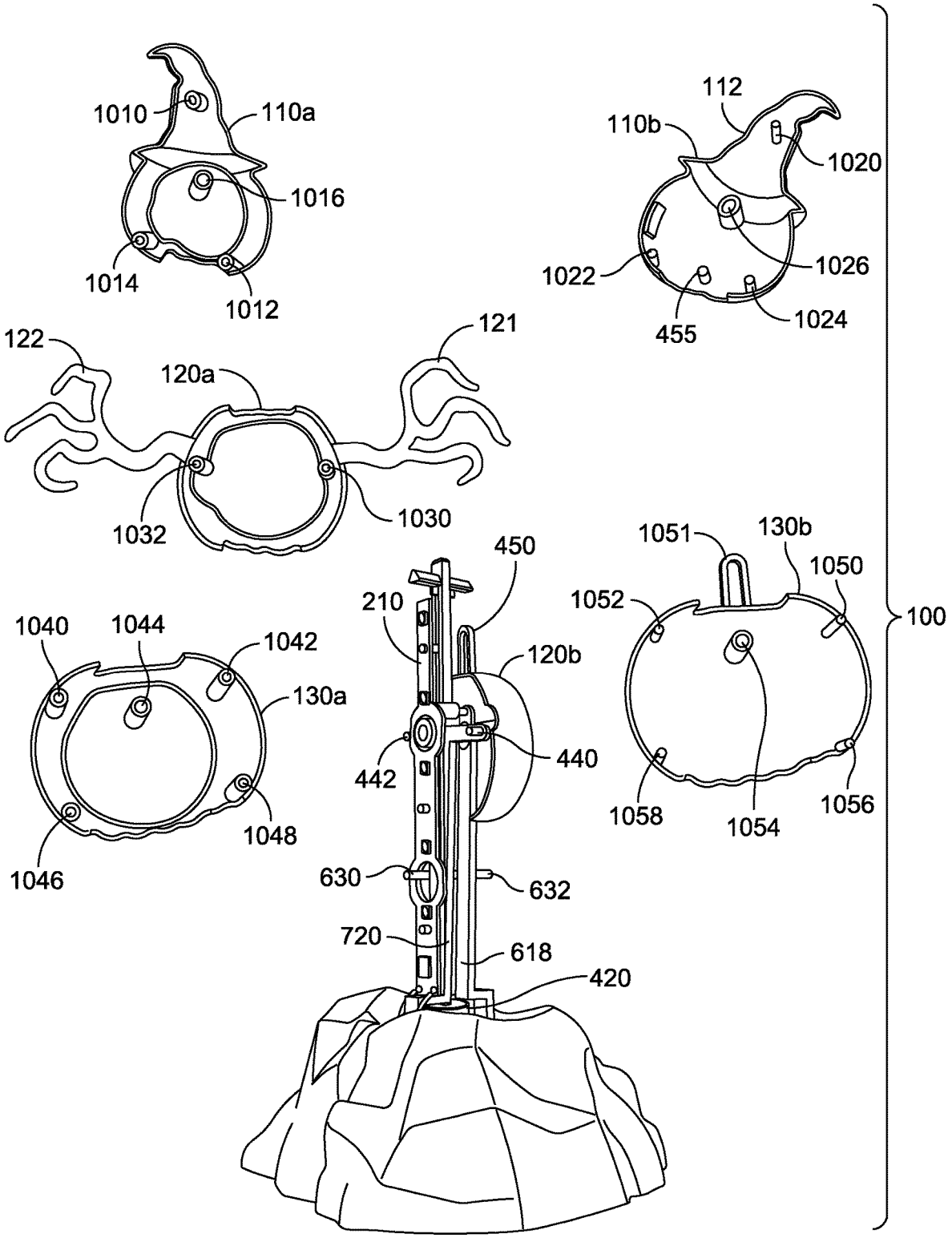
FIG. 10 is an exploded view of the display arrangement, illustrating the internal surfaces of the top, middle, and bottom shell portions, according to the present disclosure.

FIG. 10 is an exploded view of the display arrangement, illustrating the internal surfaces of the top, middle, and bottom shell portions, according to the present disclosure. The front cover 110*a* and back cover 110*b* of the top shell portion 110 are shown. The front cover 110*a* includes an opening 1010 that engages with post 1020 on the back cover 110*b*, an opening 1012 that engages with post 1022, and an opening 1014 that engages with post 1024. The front cover 110*a* includes an opening 1016 that engages with the post 612 (see FIG. 6). The back cover 110*b* includes an opening 1026 that engages with the post 614 (see FIG. 6).

The middle shell portion 120 includes a front cover 120*a* and back cover 120*b* as shown. The front cover 120*a* includes an opening 1032 that engages with post 440 and an opening 1030 that engages with post 442. This connection causes movement of the middle shell portion in a rotational direction as the post 415 moves rotationally with respect to the stem 410. The back cover 120*b* includes a loop 450 that engages with the post 455 on the back cover 110*b* of the top shell portion.

The bottom shell portion 130 includes a front cover 130*a* and a back cover 130*b* as shown. The front cover 130 includes an opening 1040 that engages with the peg 1050 on the back cover. The front cover 130*a* includes an opening 1042 that engages with the peg 1052 on the back cover 130*b*. The front cover includes an opening 1046 that engages with the peg 1056 on the back cover 130*b*. The front cover 130*a* includes an opening 1048 that engages with the peg 1058 on the back cover 130*b*. The front cover 130*a* includes an opening 1044 that engages with the peg 630 and the back cover 130*b* includes an opening 1054 that engages with the post 632 to allow for rotational movement of the bottom shell portion with respect to the elongated central post 610.

Figure 11:
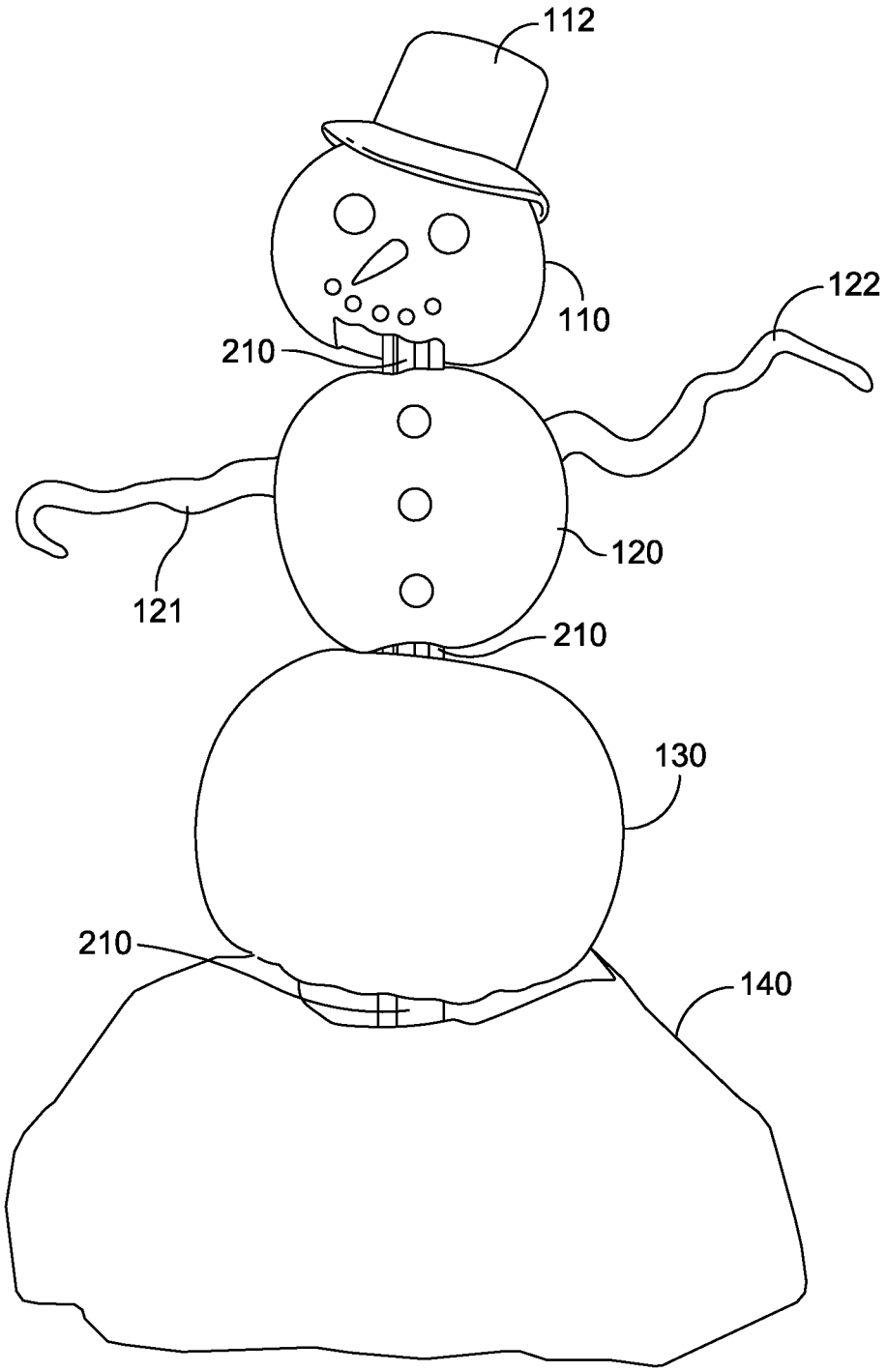
FIG. 11 is a front view of a display arrangement having a magnet that interacts with a coil to induce movement of the display arrangement, where the display arrangement is in the configuration of a snowman figure, according to the present disclosure.

FIG. 11 is a front view of a display arrangement having a magnet that interacts with a coil to induce movement of the display arrangement, where the display arrangement is in the configuration of a snowman figure, according to the present disclosure. The snowman configuration likewise includes a top shell portion 110 having a decorative hat 112, a middle shell portion 120 having arms 121, 122, a bottom shell portion 130 and a base 140. The elongated central post 210 is fixedly secured to the base 140 and pivotally connected to each of the top shell portion 110, middle shell portion 120 and lower shell portion 130, in accordance with the techniques of the present disclosure.

It will be appreciated that although certain embodiments of the present disclosure have been shown and described, it will be appreciated that other modifications and enhancements can be made within ordinary skill. For example, although only a pumpkin and snowman are specifically shown, any decorative object can be implemented in accordance with the techniques of the present disclosure. Also, although three shell portions are shown with a top, middle and bottom, a single shell could be implemented or two shell portions, depending upon the particular display or configuration desired. Also, only one of the portions may have light sources emanating therethrough, only one portion may include openings for the light source. Further, although multiple openings are shown for each shell portion, only one opening may be provided, as will be appreciated. Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A display arrangement comprising:

a base;

a decorative shell having a front cover and a back cover;

an elongated central post that is rotatably coupled to the decorative shell and fixedly coupled to the base;

a light source disposed on the elongated central post and within the shell, such that the light is visible though at least one opening in the shell;

a stem coupled to the shell and coupled to the elongated central post, the stem having a magnet on one end; and a coil configured to receive energy from a power source to cause an arcing motion of the magnet, the stem, and thereby the decorative shell.

2. The display arrangement of claim 1, wherein the power source is a battery disposed within the base.

3. The display arrangement of claim 1, wherein the power source is a solar power source coupled to the base.

4. The display arrangement of claim 1, further comprising a second shell disposed horizontally above the decorative shell, that is coupled to the decorative shell by a second post that is also coupled to the elongated central post.

5. The display arrangement of claim 4, further comprising a third shell disposed horizontally below the decorative shell, that is coupled to the decorative shell by a loop on the third shell that engages with a peg on the decorative shell.

6. The display arrangement of claim 5, wherein the elongated central post includes a second light source visible through the second shell, and the elongated central post includes a third light source visible through the third shell.

7. The display arrangement of claim 5, wherein the light source is a light emitting diode (LED).

8. A display arrangement comprising:

a base;

a lower shell portion having a lower back cover and a lower front cover;

a middle shell portion having a middle back cover and a middle front cover, the middle shell portion rotatably coupled to the lower shell portion;

a top shell portion having a top back cover and a top front cover, the top shell portion rotatably coupled to the middle shell portion;

an elongated central post having a first light source visible through an opening in the lower front cover, a second light source visible through an opening in the middle front cover, and a third light source visible through an opening in the top front cover;

a stem coupled to the elongated central post and coupled to at least the middle shell portion, the stem having a magnet on one end; and a coil configured to receive energy from a power source to cause an arcing motion of the magnet and the stem, to thereby cause the middle shell portion, the lower shell portion, and the top shell portion to rotate with respect to one another.

9. The display arrangement of claim 8, further comprising an upper post having a first peg and an opposed second peg, the first peg configured to engage with the top back cover and the second peg configured to engage with the top front cover.

10. The display arrangement of claim 8, wherein a bottom end of the upper post has opposed third and fourth pegs that are pivotally connected to the middle shell.

11. The display arrangement of claim 8, further comprising a post rotationally connected to the middle shell portion and rotationally connected to the stem, such that movement of the stem causes movement of the middle shell portion.

12. The display arrangement of claim 8, further comprising a peg on the stem configured to pivotally connect to the back bottom cover.

13. The display arrangement of claim 8, and further comprising a third shell disposed horizontally below the decorative shell, wherein the lower shell portion is coupled to the middle shell portion by a loop on the third shell that engages with a peg on the decorative shell.

14. The display arrangement of claim 8, further comprising a lower post that extends upwardly from the base and that is coupled to the middle shell portion by a loop that engages with a peg.

15. A display arrangement comprising:

a base;

a lower shell portion having a lower back cover and a lower front cover;

a middle shell portion having a middle back cover and a middle front cover, the middle shell portion rotatably coupled to the lower shell portion;

a top shell portion having a top back cover and a top front cover, the top shell portion rotatably coupled to the middle shell portion;

a stem coupled to at least the middle shell portion, the stem having a magnet on one end; and a coil configured to receive energy from a power source to cause an arcing motion of the magnet and the stem, to thereby cause the middle shell portion, the lower shell portion, and the top shell portion to rotate.

16. The display arrangement of claim 15, further comprising an elongated post having a first light source visible through an opening in the lower front cover.

17. The display arrangement of claim 15, further comprising a second light source on the central elongated post that is visible through an opening in the middle front cover, and a third light source visible through a second opening in the middle front cover.

18. The display arrangement of claim 15, further comprising a fourth light source on the central elongated post that is visible through an opening on the top front cover and a fifth light source visible through a second opening in the top front cover.

19. The display arrangement of claim 15, further comprising a post rotationally connected to the middle shell portion and rotationally connected to the stem, such that movement of the stem causes movement of the middle shell portion.

20. The display arrangement of claim 15, wherein the top shell portion defines a pumpkin shape having a hat, the middle shell portion defines a second pumpkin shape, and the lower shell portion defines a third pumpkin shape.

* * * * *